US005116322A

United States Patent [19]

Chromowsky

[11] Patent Number: 5,116,322

[45] Date of Patent: May 26, 1992

[54] METHOD AND APPARATUS FOR GLUING CLOSURE FLAPS OF A CARTON ON A CONTINUOUSLY MOVING CONVEYOR

[75] Inventor: Daniel L. Chromowsky, Howell, N.J.

[73] Assignee: Colgate-Palmolive Company, Piscataway, N.J.

[21] Appl. No.: 617,327

[22] Filed: Nov. 23, 1990

[51] Int. Cl.[5] ..... B65B 7/20; B65B 7/28

[52] U.S. Cl. ..... 53/485; 53/376.5; 53/491

[58] Field of Search ..... 53/491, 485, 377.2, 53/377.4, 376.5, 383.1

[56] References Cited

U.S. PATENT DOCUMENTS

| | | | |
|---|---|---|---|
| 3,691,724 | 9/1972 | Lense et al. | 53/376.5 X |
| 3,831,342 | 8/1974 | Rejsa | 53/376.5 X |
| 4,256,526 | 3/1981 | McDaniel | 53/376.5 X |
| 4,503,659 | 3/1985 | Sherman | 53/376.5 X |

*Primary Examiner*—James F. Coan

*Attorney, Agent, or Firm*—Michael J. McGreal; Robert C. Sullivan

[57] ABSTRACT

A leak resistant carton is formed from a cardboard blank by folding the blank to an open-ended carton. The carton is positioned on a core support member and a flexible sheet of closure material is placed over one of the open ends of the carton. A platen above the open end of the carton is actuated to fold and seal the edges of the sheet material over the sides of the carton to close the carton. The carton is then inverted on a conveyer and passed through a filling station, glue station and flap closure station. The carton is first filled and the side flaps are folded inwardly. A glue head assembly traverses the carton diagonally to apply a transverse bead of glue on the carton flaps. The remaining carton flaps are then folded inwardly to close the carton.

31 Claims, 3 Drawing Sheets 102
112
104
100
94
96
92
90
98
116
101
114

METHOD AND APPARATUS FOR GLUING CLOSURE FLAPS OF A CARTON ON A CONTINUOUSLY MOVING CONVEYOR

FIELD OF THE INVENTION

The present invention is directed to a method and apparatus for forming a carton having sift-proof seals and gluing closure flaps on the carton. More particularly the invention, in one embodiment, relates to a device for applying a glue strip in a traverse line with respect to the direction of travel of the carton on a continuously moving conveyor and, in another embodiment the forming of film seals on a carton end which are sift-proof, yet easy opening.

BACKGROUND OF THE INVENTION

The packaging of products in cartons typically employs a packaging machine of the type where the carton is filled and the closure flaps folded over each other to close the carton. Typically the carton is conveyed through the packaging apparatus where two sides are folded inwardly to expose an upwardly facing surface of at least one flap. The partially closed carton is then passed under a glue nozzle to apply one or more strips of glue on the upwardly facing surfaces in the direction of travel of the carton. The remaining flaps are then folded over to close the carton.

In order to increase the strength of the closures, it is generally desirable to apply more than one bead of adhesive to the closure flaps. Generally, multiple glue heads are provided to apply the beads of glue in a series of beads. It has further been desirable to apply a bead of adhesive around most of the perimeter of the closure flaps to reduce leakage or sifting of the contents. This type of apparatus typically includes a pair of stationary glue heads disposed above the conveyor such that glue is applied on a carton traveling on the conveyor in parallel lines along the outer edges of the closure flaps in the direction of travel. The bead of glue applied along the edges of the closure flap transverse to the direction of travel has been applied by stopping the forward movement of the carton and applying a bead of glue from a glue head moving across the conveyor. This method of gluing has the disadvantage of requiring that the carton be stopped momentarily while the glue is applied thereby disrupting the flow of the cartons. Other methods of sealing and closing cartons have avoided the disruption of the flow of cartons by rotating the cartons 90° and then passing the cartons under a second set of glue heads to apply a bead of glue along the previously unglued edges. The cartons may be rotated either manually or by automated rotating means. Such gluing apparatus requires complicated rotating devices and glue heads, and head positioning devices in order to properly glue the closure flaps on the carton. These devices for gluing and closing cartons are deficient in not providing a continuous process without reorienting the cartons on the conveyor.

Examples of the previous methods of efficiently closing and gluing cartons include U.S. Pat. No. 4,503,659. This apparatus includes means for closing a pair of leading flaps on the package and a pair of trailing flaps on a packaging machine. A plurality of stationary glue heads are positioned in line with the packaging machine. One glue head is positioned to face downwardly and downstream aimed at the leading end of the package while the other glue head is facing downwardly and upstream at the trailing flap of the package. The heads direct a vertical line of glue on the flaps such when the flaps are closed, the flaps are secured by the glue.

The above-noted carton forming apparatus does not apply a bead of glue on the transverse edges of flaps to effectively glue the carton flaps. There is still a need in the art for a continuous carton forming apparatus which is capable of applying a bead of glue around the periphery of the carton closure flap.

Another facet in providing closures for cartons is to produce easy opening, sift-proof seals. Sift-proof seals are necessary when powders such as detergents are to be packaged. It has been found that this can be conveniently formed using a film closure where the film is heat-bonded to the carton, leaving tabs on each corner that can be used for removing this film seal in a peeling motion.

SUMMARY OF THE INVENTION

The present invention is directed to a method and apparatus for forming a carton and gluing closure flaps of a package or carton on an in-line packaging machine. The carton to be glued is preferably of the type having an essentially tubular, square or rectangular shape which is open at both ends and assembled from a cardboard blank. The open end of the carton includes a pair of opposing side flaps, a rear flap and a front flap. The carton is placed on a conveyor with the open end facing upward and the side flaps facing in the leading and trailing direction with respect to the direction of travel. The conveyor carries the carton downstream to a first station where the carton is filled. At a second station downstream of the filling station, the end flaps are folded to a closed position.

The carton is then conveyed through an optional gluing station where glue, such as a hot melt glue, is applied from stationary glue nozzles to the upwardly facing surface of the front and rear flaps of the carton in lines parallel to the direction of travel. The glue applying means includes means to dispense glue in a preselected pattern to the flaps by signals produced from a control device to actuate the glue means.

At a second glue station, a second glue application device applies a bead of glue in a line extending transversely to the direction of travel of the carton on the conveyor. Although one glue head can be used, in the preferred embodiment at least two glue heads are aimed downwardly toward the upper surface of the flaps. The glue heads are mounted on a carriage for movement along a rail surface in a forward direction to the direction of travel of the carton. A diagonal cam element causes the glue head to move diagonally in a direction forward and transversely of the conveyor. The conveyor is continuously moving to carry the cartons below the second glue means. The speed of the conveyor and the forward speed of the carriage are synchronized by a control device whereby the glue is applied to the carton in a straight line transverse to the carton. A control device selectively actuates the glue heads to apply the glue in a selected pattern. In the more preferred embodiment the carriage includes two spaced apart glue heads to apply a bead of glue adjacent the forward and trailing edges of the front flap and side flaps of the carton. The carton is then conveyed through a final folding station where the rear flap is folded and glued to the side flaps followed by folding the front flap onto the rear flap. When the rear flap is closed, it is an option to have glue deposited onto the upwardly facing side of this flap by one or more glue heads located at a point after the rear flap has been closed, but prior to the front flap being folded over onto the rear flap to complete the closure.

The apparatus includes a conveyor to carry the cartons through the stations to fill, glue and close the carton. Flap closing means are provided downstream of the gluing heads to close the front flap and rear flap. The gluing means for applying the transverse bead of glue includes a carriage having a transverse track and one or more glue heads supported on the underside of the carriage. The transverse track is positioned on the carriage above the conveyor. A glue head assembly slides on the track in a transverse direction to the direction of travel of the conveyor. A cam member is positioned diagonally to the conveyor and is operatively connected to the glue head assembly by a cam follower. A control device coordinates the forward speed of the carriage with the forward speed of the conveyor such that they are substantially the same. On the forward movement of the carriage, the cam follower engages the cam member which causes the glue head assembly to simultaneously move transversely on the transverse tracks, resulting in a diagonal movement of the glue head assembly across the conveyor. The control device synchronizes the speed of the carton and coordinates it with the forward speed of the carriage such that the glue head assembly moves transversely across the upper surface of the carton in a straight line as the carton is continuously conveyed in a forward direction.

In the preferred embodiment the carton is closed at its upper end and placed on the conveyor in an inverted fashion with the open bottom end facing upwardly whereby the carton is filled from the bottom. The upper end is closed by placing an open ended carton shell on a support and placing a flexible film material over the open end. A platen device is lowered onto the film material to seal the film to the open end of the carton. In a preferred embodiment the platen includes a plurality of pivotally mounted arms which pivot downward to plow and fold the edges of the film around the carton and seal the film to the upper edges of the carton. This produces a sift-proof seal and a seal having gripping tabs at each corner for peelably removing this seal.

BRIEF DESCRIPTION OF THE DRAWINGS

The features of the invention are shown in the drawings of which the following is a brief description.

DETAILED DESCRIPTION OF THE INVENTION

The disadvantages and limitations of prior packaging apparatus are obviated while providing an efficient apparatus and method for closing and forming a leak proof carton. More particularly, the invention is directed to a method and apparatus for forming a leak proof carton having a film cover adhesively secured at one end of the carton and glued closure flaps at the opposite end. The glued closure flaps are sealed by continuous beads of glue applied to the carton flaps while the carton is continuously moving on the conveyor.

The carton of the invention is primarily of the type capable of receiving granular or powder materials. In the preferred form of the invention the carton is formed from a cardboard blank which is pre-cut and scored to define front, rear and opposite side wall panels. At least one glue tab depends from a wall panel to glue the panels together to form an open-ended square or rectangular shell. In the preferred embodiment, the carton is open at a top end and includes closure flaps depending from the front, rear and opposite side wall panels at the bottom end such that the flaps can be folded inwardly to close the bottom end of the carton.

The opening of the upper end of the carton is sealed by extending a flexible film material across the opening, and sealing the film to the outer walls around the upper edges. The film material may be any flexible material which is capable of forming a closure. The open end of the carton is generally sealed first with the film material. An optional hinged cover may then be attached to the carton over the film to provide a reclosable cover after the carton is opened by cutting or removing the film material by peeling it from the carton. The carton, after one end is sealed, is then transferred to the conveyor in an inverted position and filled. The filled carton is closed by folding the flaps inwardly in an overlapping manner and securing the flaps by a suitable glue.

Figure 1:
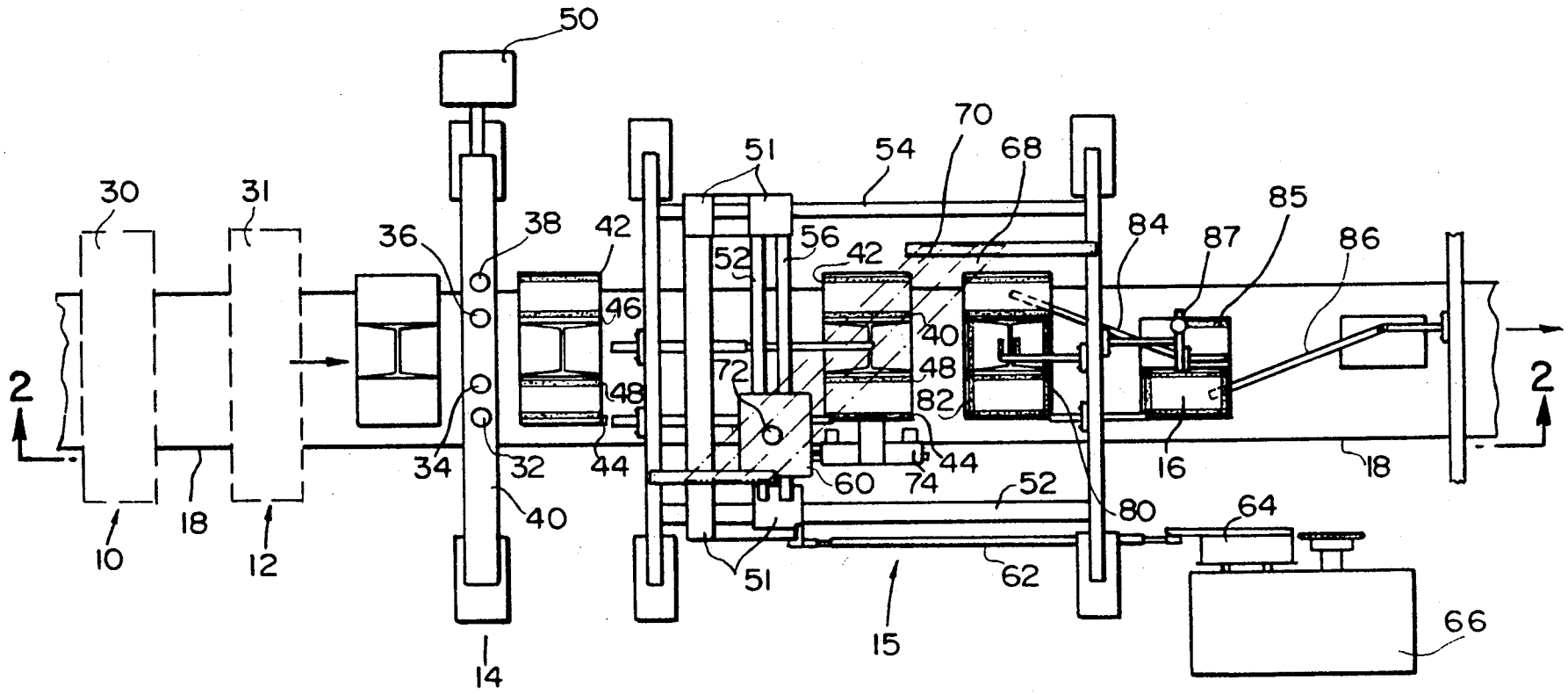
FIG. 1 is top plan view of the apparatus in accordance with the invention for assembling and gluing the carton.
Figure 2:
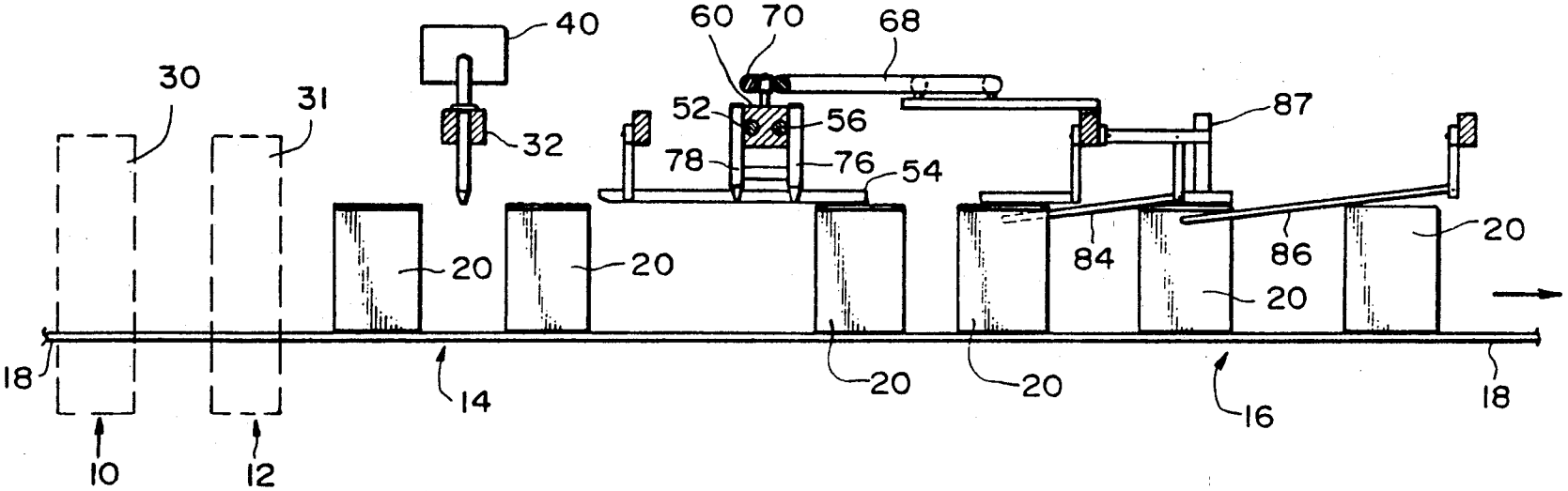
FIG. 2 is a side view of the apparatus of FIG. 1 taken along line 2—2.

Referring to FIG. 1, the apparatus of the invention for sealing the flaps of the carton includes an in-line packaging machine defining a filling station 10, first carton flap folding station 12, an optional stationary parallel gluing station 14, a transverse gluing station 15, and second flap closing station 16. Associated with this second flap closing station can be a glue head to put a bead of glue on the major flap that has been closed. A continuous conveyor 18 receives cartons 20 which are closed at one end from a conventional carton forming means. As best shown in FIG. 2, the carton 20 is placed on the conveyor 18 with the open end facing upwardly and with the bottom rear closure flap 22 (see FIG. 3), front closure flap 24 and side closure flaps 26,28 folded outwardly. The carton is passed under a filling device 30 to dispense a metered quantity of a material into the open end of the carton. The carton is then conveyed to the first closure station 31 where the side flaps 26 and 28 are folded inwardly by a conventional flap closing device.

With the side flaps 26 and 28 folded inwardly, the carton 20 is continuously conveyed under a plurality of optional glue heads 32, 34, 36 and 38 mounted on a stationary glue head support 40. The glue heads 32, 34, 36 and 38 are directed downwardly toward the upwardly facing closure flap surfaces of the carton. In the embodiment shown in FIG. 1 the glue heads are positioned to dispense a bead of glue on the front and rear closure flaps as the carton is continuously conveyed under the glue heads. As shown, glue heads 32 and 38 are positioned to optionally apply glue beads 42 and 44 adjacent the outer edges of the front and rear closure flaps 22 and 24 respectively. Glue heads 34 and 36 are positioned to optionally apply glue beads 46 and 48 adjacent the inner edges of the front and rear flaps 22 and 24 respectively. The glue heads 32, 34, 36 and 38 are stationary and apply the glue in a substantially straight bead in the longitudinal direction of travel of the carton on the conveyor. A control means 50 actuates the glue heads as a carton passes under the glue head to dispense the glue onto the carton.

In the preferred embodiment of the invention the glue heads dispense a hot melt glue that is known in the art. Alternatively, the glue may be a solvent-based glue although hot melt glues are generally preferred since they set up faster and do not rely on the evaporation of solvents.

The carton is then conveyed under a second gluing apparatus 15 to apply one or more beads of glue in a substantially straight line transverse to the direction of travel of the carton without stopping the conveyor or rotating the carton. The glue apparatus includes a carriage assembly 51 having linear bearings which slide on a pair of linear shafts 52 and 54 disposed on either side of the conveyor 18. The carriage includes a track transverse to the conveyor to support a glue head assembly 60. As shown the transverse track includes a pair of parallel rails 56, 58 on which the glue head 60 assembly rides. The glue head assembly 60 is capable of moving transversely across the conveyor on the rails 56, 58. In the embodiment shown in FIG. 1 a connecting rod 62 extends from the carriage 51 to a motor driven crank 64. The rotational movement of the crank 64 causes a reciprocating movement to the connecting rod 62 and a reciprocating movement to the carriage. A motor and control device 66 synchronizes the speed and forward movement of the carriage 51 to cooperate with the forward movement of carton 22 as discussed in greater detail hereinafter.

As shown in FIG. 1, a pair of parallel cam elements 68 and 70 are positioned above the carriage 51 and diagonally to the direction of travel of the conveyor 18. In the preferred embodiment the cam elements 68, 70 are positioned at a 45° angle to the conveyor 18. A roller or cam follower member 72 extends from the glue head assembly 60 and is received between the cam elements 68, 70 such that forward movement of the carriage along the rails causes the glue head assembly 60 to move diagonally across the conveyor.

A control device 74 produces a signal responsive to the position of a carton and actuates the forward movement of the carriage 51 and glue head assembly along the track beginning in the position as shown in FIG. 1. The carriage 51 moves along the linear shafts 52, 54 in response to the forward movement of the carton on the conveyor. In the preferred embodiment the carriage 51 moves at the same forward speed as the carton. The glue head assembly 60 is moved along the diagonally disposed cam elements 68, 78 at a forward speed which is synchronized with the forward travel of the carton. The forward speed of the carriage 51 and the glue head assembly 60 is the same as the carton whereby the glue head assembly 60 traverses the carton as the carton is continuously conveyed. In this manner the glue head is able to dispense a bead of glue in a substantially straight line along the forward, center and rearward edge of the carton transverse to the direction of travel of the carton. The control device 74 selectively actuates the glue heads to dispense the glue in a predetermined area on the carton and in a predetermined quantity. In one embodiment, two glue heads 76, 78 are supported by the glue head assembly 60 to apply two parallel beads of glue 80 and 82 on the leading and trailing edges of the rear flaps 24 and the leading and trailing edges of the side flaps 26, 28 respectively. There will also preferably be a partial application of glue to the front flap 22. In an alternative preferred embodiment, two sets of side-by-side glue heads are provided on the glue head assembly to apply four parallel beads of glue on carton flaps to provide more efficient and positive gluing of the carton flaps. In a further embodiment four glue heads are provided on the glue head assembly such that two of the glue heads apply glue to the leading and trailing edges of flap 24 and the other two glue heads apply glue to the leading and trailing edges of the end flaps 26 and 28. When the four glue heads are arranged side by side, as in this embodiment, the glue head assembly does not need to travel as far to apply glue on all edges of the carton as in the embodiment containing only two glue heads on the glue head assembly.

The glue head assembly advances along the cam elements, applying glue to the carton flaps, until it reaches the end and is then returned to the starting position as shown in FIG. 1. The carton 20 is then conveyed to a pair of closure bars 84 and 86 to fold the rear flap 22 and front flap 24 inwardly to form the bottom of the carton and seal the opening. After the front flap has been closed, a glue bead 85 can be deposited by stationary glue head 87 to provide a sealing glue when optional glue heads 32 and 34 are not used. The finished carton is then transferred to a further processing station as desired.

FIG. 2 is a side view of the apparatus showing the carton 20 on the conveyor 18 moving toward the optional stationary glue heads 32, 34, 36 and 38. The glue head assembly 60 is shown downstream from the fixed glue heads which glue head assembly carries the glue heads 76, 78. The flap closing bars 84, 86 are shown positioned above the conveyor at the downstream end.

In the embodiment as shown in FIG. 1, the carton is formed from a cardboard or chipboard blank having end flaps 26, 28 which when folded inwardly substantially cover the opening of the carton. The front flap 24 and rear flap 22 are preferably each substantially the same size as the opening of the carton such that the flaps can be folded inwardly in an overlapping manner. As can be seen in FIG. 1, the glue is applied in a pair of transverse strips 80, 82 extending from the outer edge of the front cover and across the side flaps 26, 28 and onto flap 22. The first flap closing bar 84 folds the rear cover flap 22 inwardly onto the side flaps 26, 28 followed by the second flap closing bar 86 folding the front flap 24 onto the rear flap 22. Prior to the front flap being folded onto the rear flap, glue head 87 can deposit a bead of glue on the now upwardly facing side of the rear flap.

The in-line packaging apparatus as shown in FIG. 1 and FIG. 2 provides an efficient and effective gluing and closure flap folding means for forming a leak-proof seal. The apparatus is able to apply a bead of glue around the periphery of the closure flaps in any desired manner to ensure a tight seal and inhibit leakage or sifting of the contents. Of particular advantage of the apparatus is the ability of the glue heads to apply glue in a bead longitudinally to the direction of travel of the carton and in a substantially straight line transverse to the direction of travel of the carton without stopping the carton or rotating the carton on the conveyor.

In an alternative embodiment of the glue pattern shown in FIG. 1, the glue may be applied in longitudinal lines on the outer-most edges of the side flaps 26, 28 and leading and trailing edges of front and rear flaps 24, 22. In this embodiment the front flap 24 and rear flap 22 may be approximately one half the size of the opening such that when folded inwardly, do not substantially overlap. The transverse beads of glue are preferably applied along the forward and rear edges of the side flaps 26 and 28. The glue is applied from the glue heads onto the closure flaps such that when the side flaps are folded inwardly onto the front and rear flaps, the beads of glue intersect to form a substantially continuous glue area adjacent the edge of the side flaps.

Figure 4:
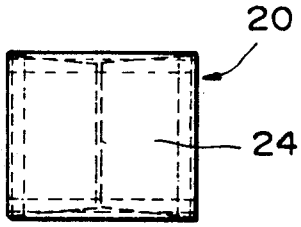
FIG. 4 is top plan view of the closed carton.

In a further alternative embodiment of the invention the glue may be applied in two parallel beads on the inner and outer edge of each of the front and rear closure flaps by the stationary glue heads. The transverse beads of glue can be applied adjacent the leading and trailing edges of the front and rear flaps to define a substantially continuous glue area around the edge of the flap. The front and rear flaps can then be folded over to form a substantially continuous seal. The finished carton will have a glue area substantially the same as shown in FIG. 4.

Figure 3:
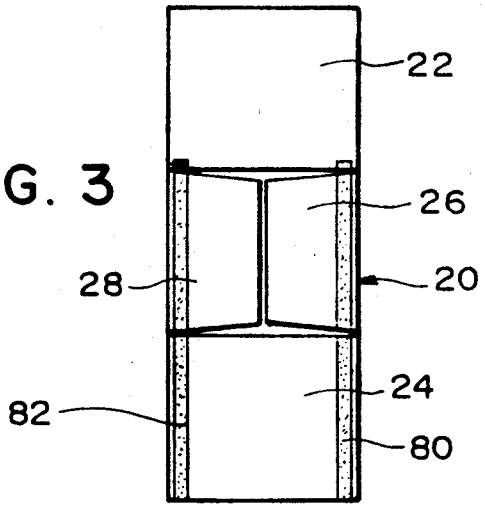
FIG. 3 is a top plan view of the carton having the glue applied thereon in a preferred embodiment.

In the preferred embodiment, the optional stationary glue heads 32, 34, 36 and 38 are not used. As is shown in FIG. 3, the transverse glue heads 68 and 70 deposit glue beads across the leading and trailing edges of side flaps 26 and 28 and front flap 24. This glue bead extends upward onto rear flap 22. Front flap 24 is then closed onto the side flaps. Glue head 87 then deposits glue bead 85 onto the reverse side of front flap 24 that is now facing upwardly. The front flap is then closed to form a leak-proof seal. The resulting seal is shown in FIG. 4.

The glue may be applied on the side flaps and on the front and rear flaps in longitudinal and transverse lines in various patterns depending on the construction of the carton and the desired glue pattern. The pattern of the glue is determined by the control device 50 to selectively actuate the optional stationary glue heads 32, 34, 36 and 38 to dispense the glue. The glue heads only need be actuated once during each pass of a carton on the conveyor. The control device 74 of the glue head assembly 60 selectively actuates the glue heads 76, 78 to apply transverse beads of glue in any desired pattern.

In the preferred embodiment of the invention, the cam elements 68, 70 are mounted in a fixed position above the conveyor. The control circuit and motor 66 actuates the forward movement of the carriage 51 to cause the glue head assembly 60 to traverse across the conveyor 18 at a forward speed complementing the forward speed of carton 20 on the conveyor 18. The forward speed of the conveyor 18 may be varied by conventional means. The control circuit is operatively connected to a speed indicator and signal producing device on the conveyor to coordinate the speed of the carriage.

In an alternative embodiment the cam elements 68, 70 are moveable to change the angle of the cam with respect to the conveyor. The angle of the cam elements 68, 70 may be adjusted to compensate for the speed of the conveyor. The angle of the cam element 68, 70 to the conveyor can also be changed to adjust the speed at which glue head assembly traverses the conveyor and can be used to control the amount of glue deposited on the moving carton by adjusting the speed of the glue head assembly. In the preferred embodiment the cam elements are fixed at an angle substantially 45° to the conveyor.

Figure 7:
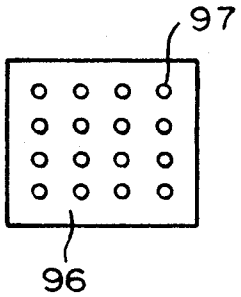
FIG. 7 is a top plan view of the support for holding the sealing film.

In the embodiments described above, the top end of the carton is closed and the carton positioned on the conveyor in an inverted manner whereby the carton is filled from the bottom end. Referring to FIGS. 5A through FIG. 5D the carton is formed from a cardboard or chipboard blank and placed on a support mandrel 90 as a hollow shell 92. The support 90 receives the carton on its upper end such that the edge 94 of the carton is flush with the upper end 96 of the support 90. The support 90 includes a vacuum chamber communicating with perforations 97 in the upper surface 96 of the support as shown in FIG. 7. A suitable vacuum connection 98 is provided to apply the vacuum to the upper surface 96.

A closure member 100 in the form of a film material is applied to the end of the carton while it is on the support 90 as depicted in sequential FIGS. 5A–5D. The closure forming apparatus 102 includes a platen 104. As shown, the platen 104 has four sides and is dimensioned substantially the same size as the end of the carton 92. Each side of the platen is provided with a downwardly pivotable arm or clamping member 112. Preferably included in each arm is a heating element such that the film 100 can be heat sealed to the sides of carton 92. Suitable actuating and control devices are operatively connected to the clamping members 112 to fold the clamping members downward to plow the edges of the film downward and then to press the edges of the film 100 onto the open end 94 of the carton.

Figures 5A, 5B, 5C, 5D, 6:
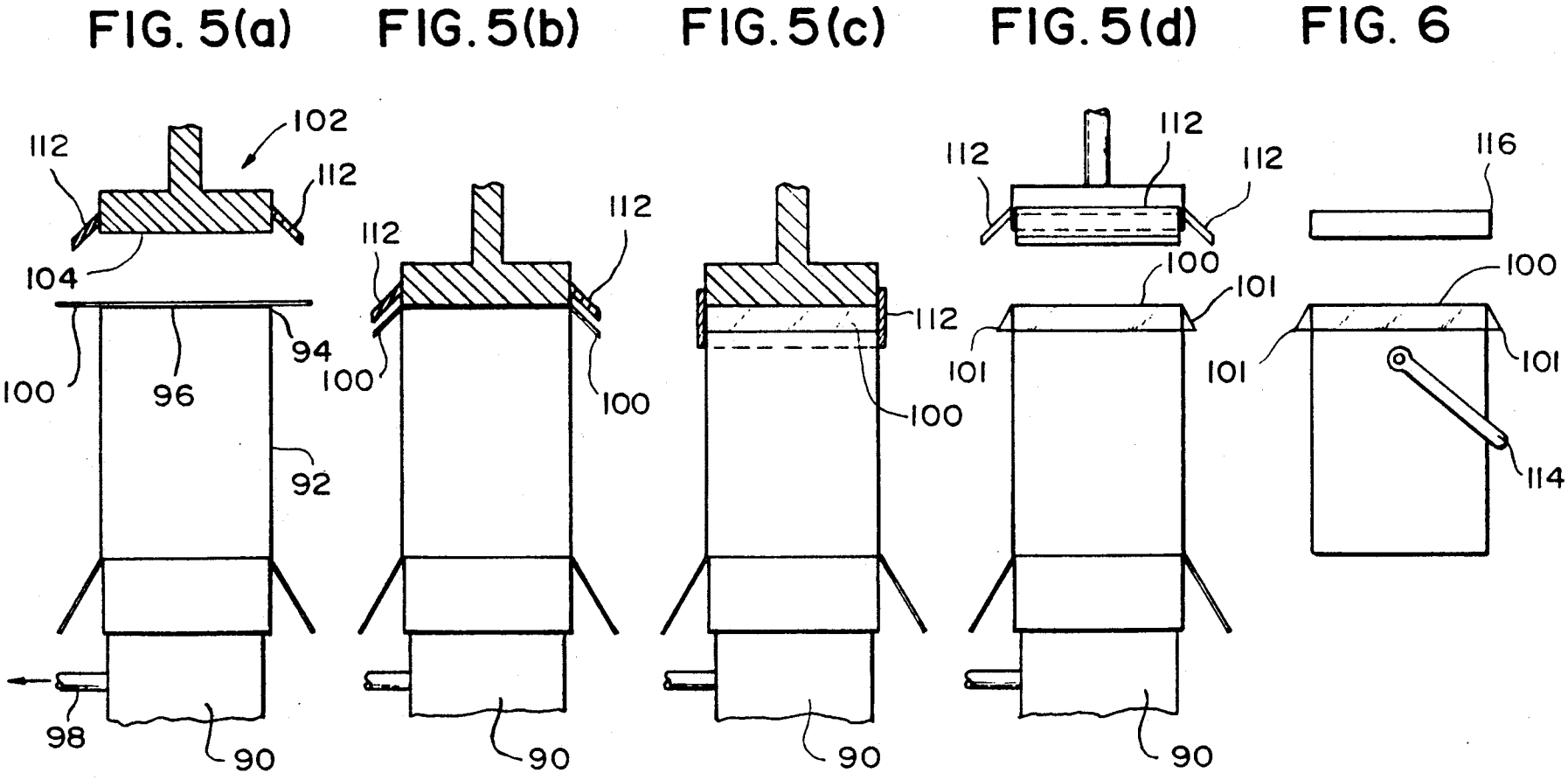
FIGS. 5A-5D are side views of the sequential movement of top closing apparatus.
FIG. 6 is an end view of the finished carton.

In operation, a sheet of film is placed on support 90 and over the top of the carton. The film material 100 is held against the top of the support 90 by vacuum and positioned above the carton as shown in FIG. 5A. The upper platen 104 is then lowered to bend and to press the film against the upper surface 96 of support 90 and to press the film around the upper peripheral end 94 of the carton as shown in FIG. 5B. In the preferred embodiment of the invention the vacuum is applied to the connection 98 to hold the film 100 in position until secured to the carton. The actuator means actuates the clamping members 112 to pres the edges of the film 100 downwardly and secure them against the sides of the carton as shown in FIG. 5C. The vacuum is then released from the support 90 and the platen 104, with clamping members 112, is raised upwardly from the carton as shown in FIG. 5D. The cycle is then repeated. When the film is sealed onto the carton, there will be excess film material 101 at each corner. This excess film material provides a convenient tab for gripping the film closure so that it can be peelably removed at the time of use.

The film material is preferably a flexible material dimensioned to fit across the open end of the carton and be folded downwardly a distance onto the upper edges of the walls of the carton as shown in the finished carton of FIG. 6. The film material may be any suitable material such as paper, plastic or wax coated paper, metal foil, laminated films or plastic films such as polyethylene, polyvinylchloride or polyvinylacetate. The film material may have a thermoplastic or an adhesive containing surface to secure the film to the carton. The adhesive may be, for example, a pressure sensitive adhesive or a heat activated adhesive. When a heat activated adhesive is used, the clamping member on the platen 104 is heated to activate the adhesive. In a preferred embodiment of the invention no adhesive is used. Rather, the film is heat bonded to the thermoplastic film surface of the carton. It is also a feature that the film may be a heat sealable thermoplastic material which can be heat sealed to the carton.

In an alternative embodiment the film material may be manually placed on the open end of the carton and the support or by means of a suitable automated feeding device. The film material may, for example, be advanced across the open end of the carton from a supply roll and cut to an appropriate size. Once the film is placed over the carton, the platen presses the film against the carton and the arms press and seal the edges against the sides of the carton.

Once the film material is secured to the carton, the carton is removed from the support 90. The carton is then inverted and placed on the conveyor for filling and closing as discussed above.

The assembled and filled carton is preferably provided with a suitable carrying handle 114 as shown in FIG. 6. The handle may be plastic strap riveted or otherwise secured to the sides of the carton. A removable closure member 116 is also provided on the assembled carton to reclose the carton after the carton is opened by cutting the film or removing the film by peeling. Preferably, the closure 116 is hingedly connected to the carton by a flexible tape.

The above description is intended to be exemplary of the preferred embodiments of the invention. It will be readily understood by those skilled in the art that numerous alternative embodiments can be made without departing from the spirit and scope of the invention.

What is claimed is:

1. Apparatus for forming a carton from an open ended carton shell having a front, rear and two opposing side flaps, said apparatus comprising;

transporting conveyor means for carrying a plurality of cartons in a conveying direction with an open end of each carton facing upwardly on the conveyor, said carton positioned on said conveyor with at least one closure flap folded outwardly;

glue means to apply glue to at least one closure flap in a substantially straight line substantially perpendicular to the conveying direction wherein said glue means comprises a carriage rectilinearly reciprocal in a direction substantially parallel to the direction of travel of the conveyor, at least one glue head assembly mounted on said carriage and rectilinearly reciprocal in a direction transverse to the direction of the carriage, and cam means operatively connected to said glue head assembly whereby linear movement of said carriage in the direction of travel of said conveyor moves said glue head assembly in a forward diagonal direction with respect to said conveyor to apply said glue in the transverse line; and closing means to fold said outwardly facing closure flaps inwardly to close said carton.

2. The apparatus of claim 1 comprising a stationary glue head associated with said closing means for depositing a bead of glue onto the upward facing side of a closed flap.

3. The apparatus of claim 1 wherein said cam means comprises a pair of parallel spaced-part rectilinear cam elements positioned diagonally with respect to the conveyor and wherein said glue head assembly includes a roller member operatively received between said cam elements.

4. The apparatus of claim 1 wherein said carriage is mounted on a pair of substantially parallel shafts disposed on each side of said conveyor.

5. The apparatus of claim 4 wherein said carriage includes a pair of transverse guide rails and said glue head assembly is reciprocally mounted on said transverse guide rails.

6. The apparatus of claim 1 including motor means to reciprocate said carriage at a forward speed with respect to the conveying direction substantially the same as a forward speed of a carton being glued whereby a substantially transverse glue line is applied to the carton.

7. The apparatus of claim 1 wherein said gluing means including two glue heads are cooperatively engaged to each other to apply two substantially parallel transverse glue strips on said flap.

8. The apparatus of claim 1 including at least one stationary glue means to apply a substantially straight glue strip on a flap longitudinally to the conveying direction.

9. The apparatus of claim 1 including control means to synchronize the forward speed of said glue head with the forward travel of said carton whereby said glue is applied in a transverse line.

10. The apparatus of claim 1 including speed indicator means to determine the speed of a carton on said conveyor and means to control the forward speed of the glue head whereby glue is applied to said carton in a transverse line.

11. The apparatus of claim 1 including control means to actuate said glue head and apply glue on said carton in a preselected pattern.

12. The apparatus of claim 1 including means to fold leading and trailing flaps inwardly positioned downstream of said glue head.

13. A method of closing a carton in a packaging apparatus wherein the carton includes front, rear and two opposing side flaps hingedly connected to a body of the carton, said method comprising;

continuously conveying said cartons on a transport conveyor means with at least one of said flaps facing upwardly and with a longitudinal axis of said carton faced in a conveying directing of said conveyor means;

traversing a gluing means diagonally with respect to the conveying direction of said carton by mounting said gluing means into a carriage and moving said carriage in a direction parallel to the conveying direction of said cartons, whereby a cam associated with said gluing means causes said gluing means to traverse diagonally with respect to the conveying direction as said carriage moves parallel to said conveying direction; and folding said flaps inwardly to close said carton and secure said flaps.

14. The method of claim 13 comprising positioning said carton on the conveyor means whereby end flaps of said carton are oriented in a leading and trailing direction of the carton and folding said end flaps inwardly before applying said glue.

15. The method of claim 13 comprising applying at least two transverse glue strips on said at least one upwardly facing surface.

16. The method of claim 13 comprising conveying said carton under a stationary glue means to apply a substantially straight strip of glue longitudinally with respect to the conveying direction on said upwardly facing surface.

17. The method of claim 16 comprising conveying said carton under at least two downwardly directed stationary glue heads and applying a glue strip adjacent each longitudinal edge of said upwardly facing surface and applying a glue strip transversely adjacent leading and trailing edges of said upwardly facing surface to form a substantially continuous glue area about the periphery of said upwardly facing surface.

18. The method of claim 14 wherein said glue transverse to the conveying direction is applied onto upwardly facing surfaces of said end flaps.

19. The method of claim 14 comprising applying said glue transverse to the conveying direction on at least one of a front and rear flap of said carton.

20. The method of claim 14 comprising applying said glue transverse to the conveying direction on upwardly facing surfaces of front and rear flaps of said carton.

21. An apparatus for forming a closed carton comprising, a support to receive a carton shell having an open upper end and an open bottom end, said carton having two opposing side closure flaps and a front and rear closure flap depending from side walls of said carton adjacent said bottom end, said support receiving said carton shell whereby a substantially flat, upper end of said support is substantially flush with the upper end of said carton shell;

means to position a flexible closure member over said open end of the carton, platen means having pivotally mounted arm members to fold peripheral edges of said flexible closure member over said open end of the carton shell and to secure said edges to side walls of said carton shell to close said open upper end of said carton shell.

22. The apparatus of claim 21 further comprising;

transporting conveyor means to receive said cartons from said support with said open bottom end of each carton facing upwardly on the conveyor, said cartons positioned on said conveyor with at least one closure flap folded outwardly;

glue means to apply glue to at least one of said outwardly facing flaps in a substantially straight line transverse to the conveying direction, wherein said glue means includes at least one glue head rectilinearly reciprocal in the conveying direction and diagonally to the conveying direction whereby said glue nozzle moves in a forward direction and in a transverse direction at a speed to apply glue in a substantially straight line transverse to the conveying direction on the flap while the carton is moving on the conveyor, and flap closing means to fold said outwardly facing flap inwardly to close said carton.

23. The apparatus of claim 21 wherein said support includes vacuum means to hold said flexible closure member against the upper edge of said carton while securing said closure member to the carton.

24. The apparatus of claim 21 wherein said support includes a substantially flat face means to define a vacuum chamber, means to communicate said vacuum chamber with said flat face, and a means to operatively connect said vacuum chamber with said vacuum means.

25. The apparatus of claims 21 wherein said support has four orthogonal sides and said platen has four orthogonal sides and four pivotally mounted arms connected to said sides of the platen, and wherein said platen is operable to actuate said arms to fold the edges of said closure members onto the side walls of said carton.

26. The apparatus of claim 21 including heating means to heat said arms to heat seal said flexible closure member to said side walls of the carton.

27. The apparatus of claim 22 including at least one stationary glue means to apply a substantially straight glue strip on a flap longitudinally to the conveying direction.

28. An apparatus for applying glue to a carton on a continuously moving conveyor means, wherein said conveyor means carries cartons with at least one upwardly facing glue surface at a substantially constant forward speed in a forward direction, said apparatus comprising;

glue means reciprocal in a direction diagonally to the forward direction of said carton and across the upwardly facing surface, wherein said glue means comprises a carriage rectilinearly reciprocal in a direction substantially parallel to the direction of travel of the conveyor, at least one glue head assembly mounted on said carriage and rectilinearly reciprocal in a transverse direction to the carriage, and cam means operatively connected to said glue head assembly whereby linear movement of said carriage in the direction of travel of said conveyor moves said glue head assembly in a forward diagonal direction with respect to said conveyor to apply said glue in the transverse line; and control means to reciprocate said glue means whereby said glue means has a forward speed substantially the same as said forward speed of said carton, wherein said control means actuates said glue means in response to a position of said carton on the conveyor to apply a substantially transverse strip of glue to said upwardly facing surface.

29. The apparatus of claim 28 wherein said carriage is mounted on a pair of substantially parallel shafts disposed on each side of said conveyor.

30. The apparatus of claim 29 wherein said carriage includes a pair of transverse guide rails and said glue head assembly is reciprocally mounted on said transverse guide rails.

31. The apparatus of claim 28 wherein said cam means comprises a pair of parallel spaced-apart rectilinear cam elements positioned diagonally with respect to the conveyor and wherein said glue head assembly includes a roller member operatively received between said cam elements.

* * * * *

UNITED STATES PATENT AND TRADEMARK OFFICE

CERTIFICATE OF CORRECTION

PATENT NO. : 5,116,322

DATED : May 26, 1992

INVENTOR(S) : Daniel L. Chromowsky, Charles G. Tinnel, and William C. Dease, Jr.

It is certified that error appears in the above-indentified patent and that said Letters Patent is hereby corrected as shown below:

Column 10, line 41, after "conveying": delete [directing] and insert --direction--.

Column 12, line 4, after "apparatus of": delete [claims] and insert -- claim--.

Signed and Sealed this

Fifth Day of September, 1995

*Attest:*

*Attesting Officer*

Bruce Lehman

BRUCE LEHMAN

*Commissioner of Patents and Trademarks*